US006453653B2

(12) United States Patent
Grönberg

(10) Patent No.: US 6,453,653 B2
(45) Date of Patent: Sep. 24, 2002

(54) STIRRUP STRAPPING ARRANGEMENT FOR THE SADDLE OF A HORSE OR THE LIKE RIDING ANIMAL

(76) Inventor: Pauli Grönberg, Koskitie 11, Fin-04300 Tuusula (FI)

( * ) Notice: Subject to any disclaimer, the term of this patent is extended or adjusted under 35 U.S.C. 154(b) by 0 days.

(21) Appl. No.: 09/769,759

(22) Filed: Jan. 26, 2001

(30) Foreign Application Priority Data

Jan. 26, 2000 (FI) ..... 000032 U

(51) Int. Cl.[7] ..... B68C 1/16
(52) U.S. Cl. ..... 54/46.1
(58) Field of Search ..... 54/46.1, 47; D30/135, D30/142, 143

(56) References Cited

U.S. PATENT DOCUMENTS

D251,623 S * 4/1979 Abercrombie, Jr. ..... D30/135
4,287,705 A * 9/1981 Frost et al. ..... 54/46.1
4,608,812 A * 9/1986 Willson ..... 54/46.1

FOREIGN PATENT DOCUMENTS

CA 460990 * 11/1949 ..... 54/46.1
GB 25611 * 12/1900 ..... 54/46.1

* cited by examiner

*Primary Examiner*—Charles T. Jordan
*Assistant Examiner*—Elizabeth A. Shaw
(74) *Attorney, Agent, or Firm*—Kubovcik & Kubovcik

(57) ABSTRACT

A strapping arrangement for a stirrup of a saddle of a horse or other riding animal so as to carry the weight of a rider's foot on the stirrup. Strapping means are connected to multiple portions of the saddle so that the weight imposed by the rider's foot on the stirrup is distributed at least substantially uniformly over the saddle.

3 Claims, 1 Drawing Sheet

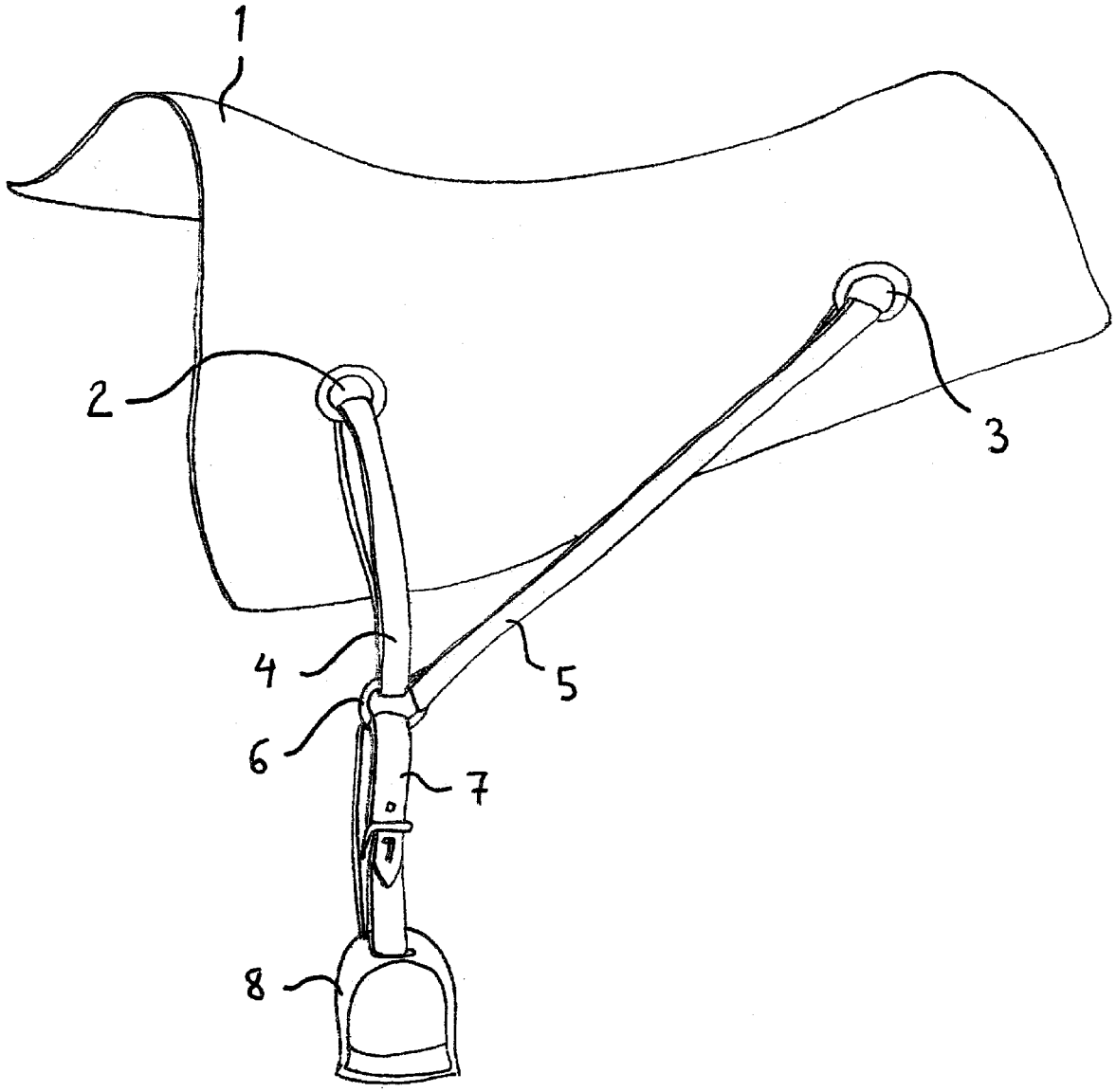
1
2
3
4
5
6
7
8

STIRRUP STRAPPING ARRANGEMENT FOR THE SADDLE OF A HORSE OR THE LIKE RIDING ANIMAL

The present invention relates to the strapping of a stirrup for the saddle of a horse or the like riding animal using strapping means such as stirrup straps or wires offering secure support to the rider's foot in the stirrup.

Conventional saddles are problematic inasmuch the stirrup straps are attached to the front portion of the saddle, thus causing the rider's weight to be imposed on a small area in the front part of the saddle frame, thereby compressing the horse's back in an unpleasant manner. In the long run, this kind of uneven weight distribution on the horse's back may cause muscular injuries and spinal disorders difficult to heal. Uneven distribution of the rider's weight is particularly evident during jumps.

It is an object of the invention to provide a stirrup strapping arrangement that is free from the above-described problems. The stirrup strapping according to the invention is characterized in that the strapping means are supported to the saddle so as distribute the load imposed by the rider's weight on the stirrup over at least a major portion of the saddle. Resultingly, the saddle cannot at any time compress only a single point of the horse's back, but rather, the rider's weight transmitted from the stirrups compresses the saddle over its entire length uniformly against the horse's back. Particularly advantageously the arrangement is suited for use in conjunction with a saddle that is individually contoured to match the shape of a given horse. This kind of saddle and its manufacturing method is described in EP Pat. Appl. No. 98203108.0.

A preferred embodiment of the stirrup strapping arrangement according to the invention is characterized in that the stirrup strapping means comprise a first strap connected to the front portion of the saddle and a second strap connected close the rear portion of the saddle, both straps being connected to each other by means of an eyelet or the like connecting member at a point downward from the saddle skirt, closer to the front portion of the saddle, the eyelet further having attached thereto a lower strap supporting the stirrup. This kind of arrangement provides an easy and advantageous way of distributing the rider's weight more evenly over frame of the saddle.

Another preferred embodiment of the invention is characterized in that the first strap connected to the front portion of the saddle is aligned essentially vertical, while the second strap connected to the rear portion of the saddle extends obliquely downward from its connection point at the rear portion of the saddle to a connection point located substantially midway between the stirrup and the connection point of the first strap to the front portion of the saddle.

A still another preferred embodiment of the invention is characterized in that said stirrup strapping means are formed a single length of strap or wire having its ends connected to connection points provided on the saddle, whereby the stirrup or the support strap/wire thereof is connected to said single length of strap/wire at a point located downward from the saddle skirt and substantially close to the front portion of the saddle.

In the following, the invention will be described in greater detail by way of making reference to the appended drawing in which a preferred embodiment of the strapping arrangement according to the invention is shown in a three-dimensional and simplified illustration.

Referring to the drawing, therein is shown a frame 1 of a saddle. Complementing the frame, a finished saddle also has padding parts that may be manufactured in the fashion described in cited EP Pat. Appl. No. 98203108.0. This manufacturing method provides a saddle that is contoured individually compliant to the shape of a given horse. Later in the text, the saddle frame 1 shown in the drawing may be called simply a saddle. The saddle has a first connection point 2 at the front portion of the saddle and a second connection point 3 close to or at the rear portion of the saddle. To the first connection point 2 is connected a first strap 4 and to the second connection point 3 a second strap 5. These two straps are joined to each other by means of, e.g., a connecting eyelet 6 so that the first strap at the front of the saddle hangs down substantially vertically, while the second strap at the rear of the saddle extends obliquely downward from the second connection point 3 at the rear of the saddle toward the connecting eyelet 6. Advantageously, the joining point is arranged so that the second strap 5 connected to the rear of the saddle meets the connecting eyelet 6 at a point which is located substantially midway between the stirrup and the connection point 2 of the first strap 4 at the front portion of the saddle. Thus, the eyelet 6 supports the stirrup 8 by means of a strap 7. The lengths of the straps 4 and 5 must be adjusted such that with the full weight of the rider resting on the stirrups, both straps 4, 5 will be tensioned so that the rider's weight is transmitted evenly via both straps to the saddle and therefrom onto the back of the riding animal.

To those versed in the art it is obvious that the invention is not limited to the exemplifying embodiment described above, but rather, can be varied within the scope and spirit of the appended protective claims. Accordingly, the straps 4 and 5 may be replaced by a single longer strap or wire that has its ends connected to the above-described connection points 2 and 3, while the connecting eyelet 6 is directly attached to the single strap or wire. The implementation and form of the strapping arrangement is broadly characterized in that it is capable of distributing the rider's weight over the saddle frame and thus over the riding animal's back.

What is claimed is:

1. Strapping arrangement for the stirrup of a saddle of a riding animal comprising first and second strapping means connected to the saddle so that the weight imposed by a rider's foot on the stirrup is distributed at least substantially uniformly over the saddle, said first strapping means being connected to a front portion of the saddle at a first connecting point so as to hang down substantially vertically and said second strapping means being connected to a rear portion of the saddle at a second connecting point so as to extend obliquely downward from the rear portion of the saddle toward a common connecting point with said first strapping means, said common connecting point being located substantially midway between the stirrup and said first connecting point.

2. The strapping arrangement according to claim 1, characterized in that said common connecting point is a connecting eyelet and a third strapping means is connected to said connecting eyelet for supporting the stirrup.

3. The strapping arrangement according to claim 1, characterized in that said first and second strapping means comprise a single strapping means having respective ends thereof connected to said first and second connecting points and said third strapping means is connected to said single strapping means at a point located downward from a skirt of the saddle and substantially close to the front portion of the saddle.

* * * * *